US006675617B2

(12) United States Patent
Stemmerik

(10) Patent No.: US 6,675,617 B2
(45) Date of Patent: Jan. 13, 2004

(54) BURGLAR-PROOF CYLINDER LOCK

(76) Inventor: Henrik Dirk Stemmerik, Bredager 17, Brondby (DK), DK-2605

( * ) Notice: Subject to any disclaimer, the term of this patent is extended or adjusted under 35 U.S.C. 154(b) by 0 days.

(21) Appl. No.: 10/169,135

(22) PCT Filed: Dec. 27, 2000

(86) PCT No.: PCT/DK00/00733

§ 371 (c)(1),
(2), (4) Date: Jun. 27, 2002

(87) PCT Pub. No.: WO01/48340

PCT Pub. Date: Jul. 5, 2001

(65) Prior Publication Data

US 2002/0189309 A1 Dec. 19, 2002

(30) Foreign Application Priority Data

Dec. 27, 1999 (DK) ..... 1999 01842
Jan. 31, 2000 (DK) ..... 2000 00153

(51) Int. Cl.[7] ..... E05B 27/00
(52) U.S. Cl. ..... 70/493; 70/359; 70/419
(58) Field of Search ..... 70/359, 358, 378, 70/376, 419, 493

(56) References Cited

U.S. PATENT DOCUMENTS 3,125 A * 6/1843 Voorhies ..... 70/359 X
1,095,500 A * 5/1914 Hansen ..... 70/359
2,051,772 A 8/1936 Turrell
2,158,501 A * 5/1939 Gutman ..... 70/493
2,194,959 A 3/1940 Voight
2,565,531 A * 8/1951 Spiegle ..... 70/493
3,818,732 A * 6/1974 Tria, Jr. et al. ..... 70/359
3,869,889 A * 3/1975 Prahl ..... 70/419
4,403,486 A * 9/1983 Miyake ..... 70/378 X
4,856,309 A * 8/1989 Eizen ..... 70/359
4,996,856 A * 3/1991 Lin et al. ..... 70/359
5,123,268 A * 6/1992 Eizen ..... 70/359
5,222,383 A * 6/1993 Fann et al. ..... 70/358
5,894,750 A * 4/1999 Liaw ..... 70/359
5,931,036 A * 8/1999 Keller ..... 70/493 X
5,966,971 A 10/1999 Keller

FOREIGN PATENT DOCUMENTS

DE 633 753 8/1936
EP 0 452 297 10/1991

* cited by examiner

*Primary Examiner*—Suzanne Dino Barrett
(74) *Attorney, Agent, or Firm*—Browdy and Neimark, P.L.L.C.

(57) ABSTRACT

A cylinder lock with a body, in which a plug with a profiled, axially extending key slot is rotatably arranged, and in which the body and the plug are provided with a number of bores approximately perpendicular to the plug axis, in which bores a number of locking pins is provided, said locking pins consisting of tumbler pins and driver pins, and in which the locking pins are lifted by insertion of a key so that the end faces of the tumbler pins flush with the periphery of the plug. With a view to preventing the lock from being opened with a tool which has a striking effect on the locking pins, at least one of the driver pins consists of two members, one member being movable relative to the second one in the longitudinal direction of the pins, and the movable member abutting in the rest position against the second member with a contact portion directed towards the plug.

9 Claims, 6 Drawing Sheets

BURGLAR-PROOF CYLINDER LOCK

Figure 1:
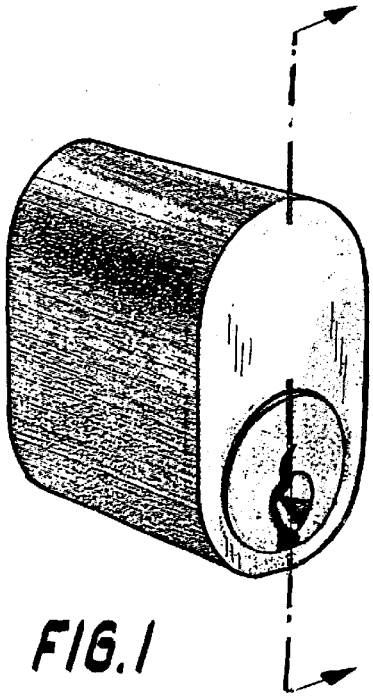

The present invention relates to a cylinder lock with a body, in which a plug with a profiled, axially extending key slot is rotatably arranged, and in which the body and the plug are provided with a number of bores approximately perpendicular to the axis of the plug, in which bores a number of locking pins is provided, said locking pins comprising tumbler pins and driver pins, and in which the locking pins are lifted by insertion of a key such that the end faces of the tumbler pins flush with the circumferential surface of the plug, in which at least one of the driver pins comprises two members, of which a first member is movable relative to the second one in the longitudinal direction of the pins.

Locks of this type are commonly known and have a reputation of being reliable and offer the possibility of a large number of locking combinations without the locks becoming mechanically complicated. A drawback in the locks is that in case of the most widely known type with five or six locking pins, it is possible to open the locks with a comparatively simple equipment. The picking of the lock is performed by insertion in the key slot of an instrument which is arranged to act on all locking pins with an upwards stroke. By the impact the locking pins are influenced by a force which is transmitted through the tumbler pins to the driver pins which are then lifted free of the plug. It then becomes possible, in the short moment, in which the driver pins are lifted free of the plug, to rotate the plug, the lock thereby becoming open. Several arrangements have been proposed for the manufacture of locks, in which such a picking is not possible. Locks have for instance been manufactured, in which, in addition to the profiling on the upper edge of the key, a profiled groove is provided on one side of the key. The additional groove makes the lock more complicated and makes, in particular, the manufacture of additional copies of a certain key complicated and costly.

EP patent application No. 0 452 297 discloses a lock of the type mentioned by way of introduction, in which the spring-loaded driver pin is designed with a stepped portion extending in the direction towards the plug and is provided with a bush member displaceable relative to the driver pin. When the locking pins are affected by an impact, the driver pin moves, whereas the bush member, which is placed with its end face facing the plug at a distance from the tumbler pin, according to this publication will remain in substantially the same position and block any movement of the plug. Even though this arrangement, at least in theory, provides the effect aimed at, it is a requirement that the lock cylinder is positioned in such a manner that the locking pins extend downwards relative to the plug to move the bushing member in a position of rest downwards by gravitation to ensure a correct functioning. This orientation is, however, disadvantageous as it becomes easier in this way to pick the lock.

The object of the present invention is to provide a cylinder lock which offers a very high security against picking, and in which this effect can be attained, also in case of simply built locks with only five or six locking pins.

This object is met by means of a cylinder lock of the type mentioned by way of introduction, the lock according to the invention being characterized by the subject matter of the characterizing clause of claim 1.

The invention resides in the realization that the picking of cylinder locks is based on a dynamic effect. The stroke towards the tumbler pin is transmitted to the driver pin which is thereby lifted without any actual movement of the tumbler pin. By the arrangement according to the invention the effect of the impact is transmitted to the movable member which constitutes one part of the driver pin. The second member of the driver pin remains approximately stationary and therefore remains in the parting surface between plug and body, the result being that the plug cannot be rotated. If only one of the locking pins of the cylinder lock is designed as comprising two members, the desired pick-proof effect is attained, but if desired, several of the driver pins may consist of two members without making the lock substantially more costly. Hereby, an additional security is obtained against the pick-proof effect not being hampered on account of failure to maintain the lock.

Particular embodiments of the invention will appear from the dependent claims.

Figure 1B:
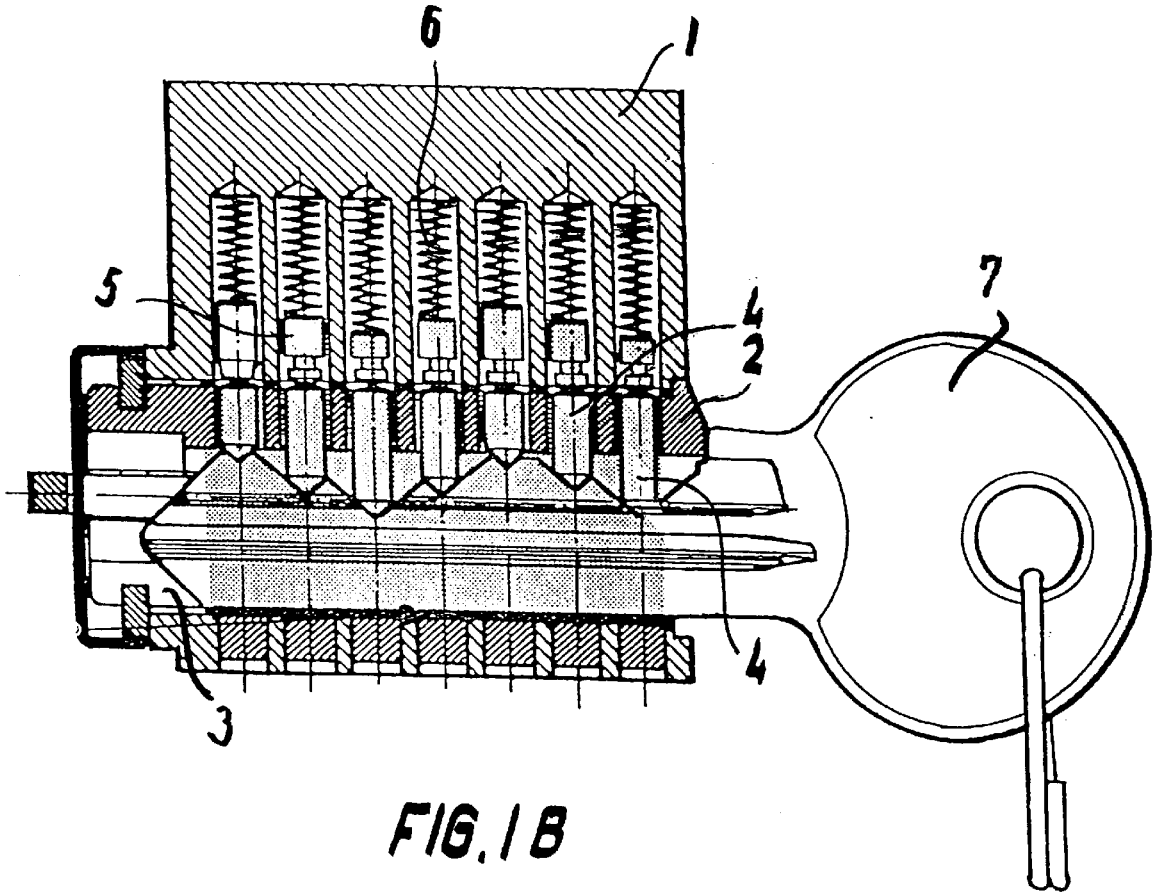
Figure 2:
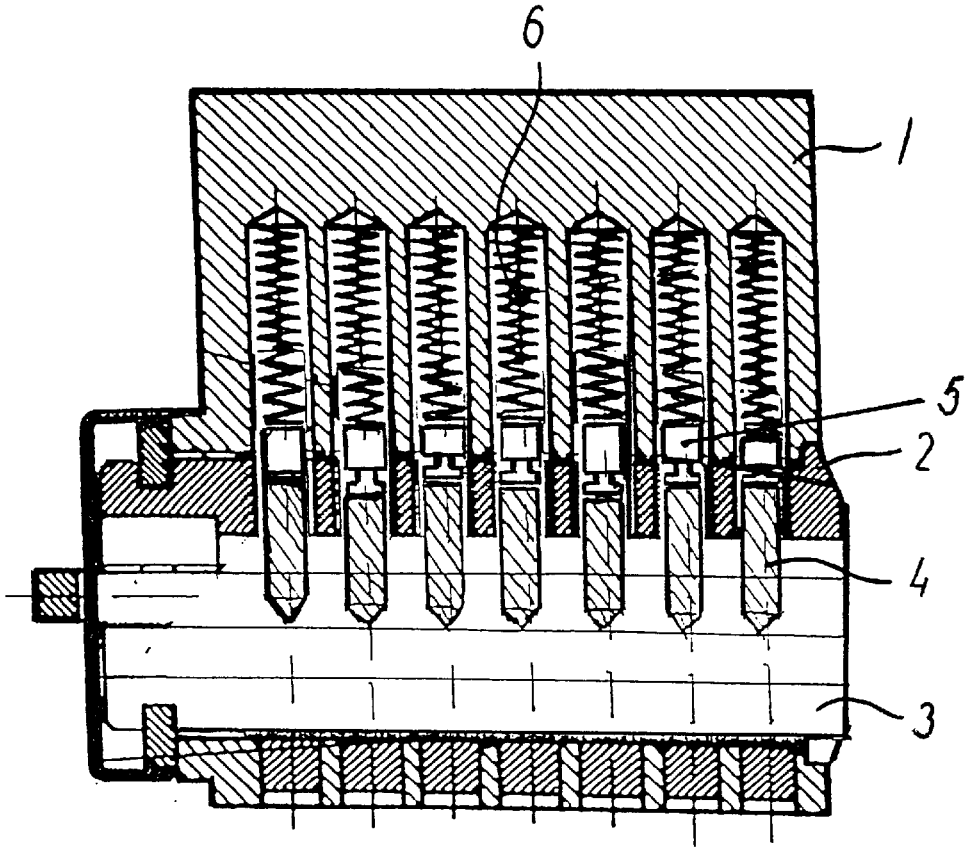
Figure 3:
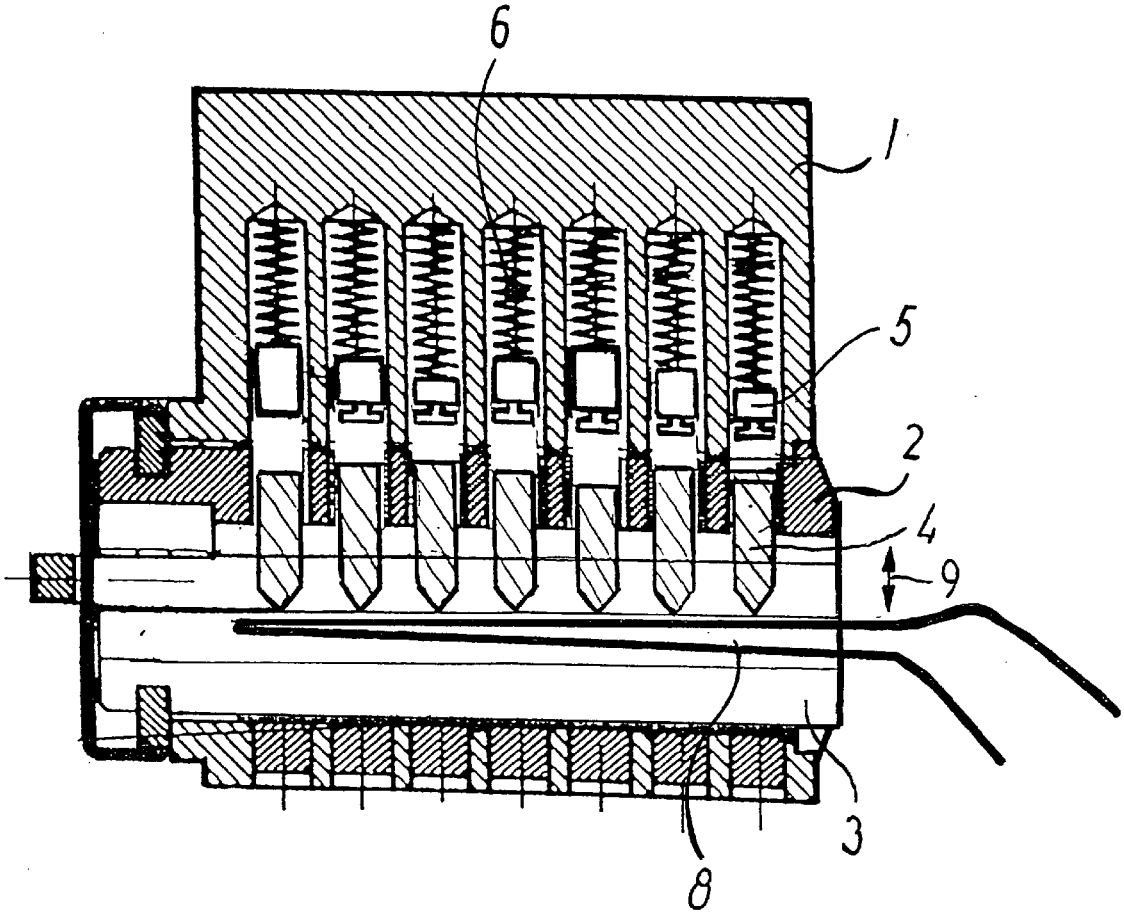
Figure 4:
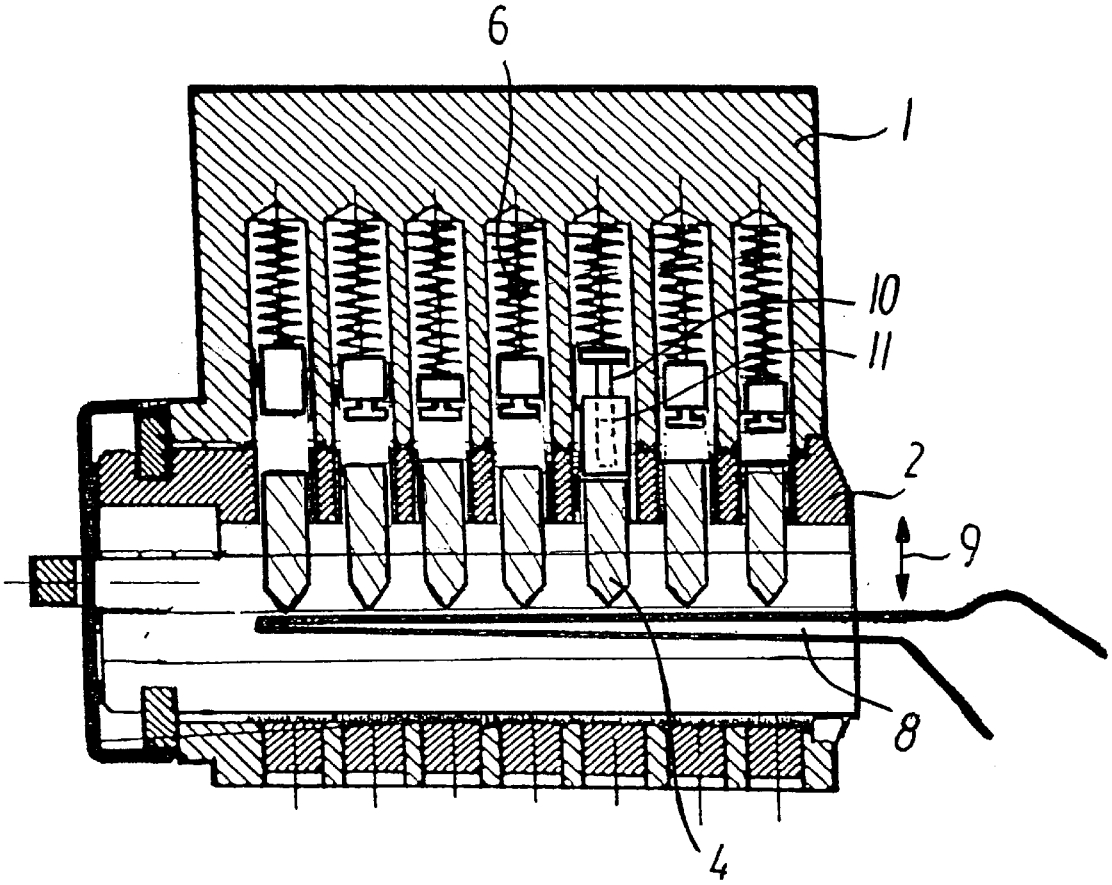
Figure 5B:
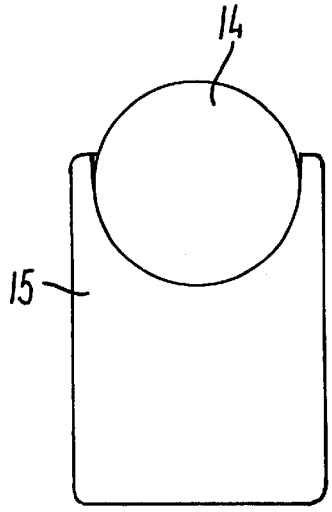
Figure 5D:
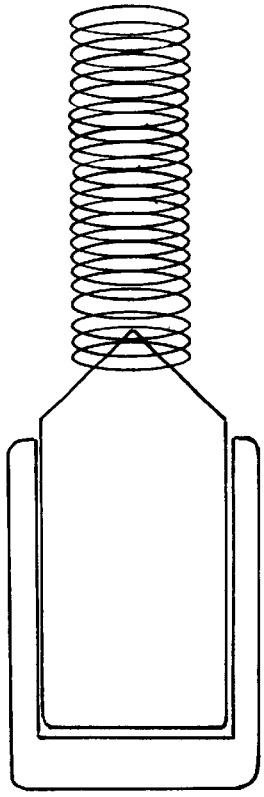
Figure 5C:
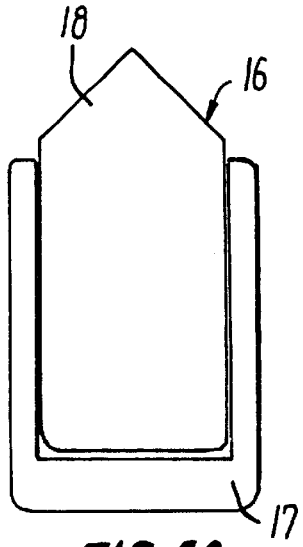
Figure 5A:
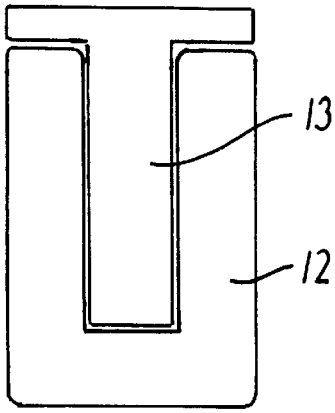
Figure 6:
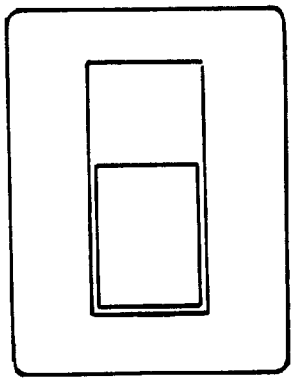
Figure 7:
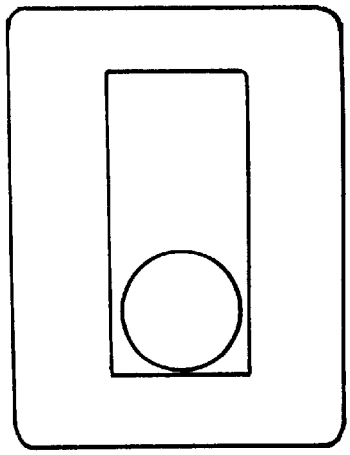
Figure 8:
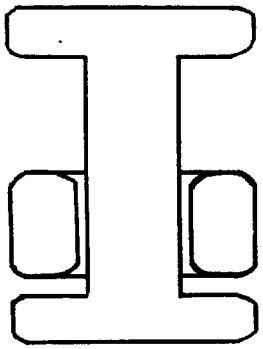

The invention will now be described in detail in the following with reference to the drawings, in which FIG. 1A shows a photo of a lock cylinder of the type related to by the invention, FIG. 1B is a sectional view through a lock cylinder of known type with an associated key inserted, FIG. 2 shows the cylinder lock according to FIG. 1B without key, FIG. 3 is a sectional view of a cylinder lock with a lock pick tool inserted in the lock and in a position, in which the driver pins have been pushed up, FIG. 4 is a sectional view of a cylinder lock according to the invention, in which a two-piece driver pin prevents the opening of the lock, FIGS. 5A, 5B and 5C show various embodiments of two-piece driver pins, and FIG. 5D shows, how the spring is mounted on a two-piece driver pin, and FIGS. 6, 7 and 8 are alternative embodiments of a divided driver pin.

The invention relates to cylinder locks of the type shown in FIG. 1A, and similar types, in which the lock cylinder is differently designed. Common to these locks is, as appears from FIG. 1B, a body or housing 1, in which a plug 2 is mounted in such a manner that it can be rotated about its axis. In the plug 2, a key slot 3 is provided, which is provided with a profiling which is complementary relative to the profiling of the key. In the plug and in the body a number of bores is provided, in which bores the locking pins and the springs are mounted. The locking pins are divided into a tumbler pin 4 and a driver pin 5. The springs 6 press the locking pins against the profiling of the key. When the key fitting the lock is inserted, the locking pins are lifted to such an extent by the key 7 that the end face of the tumbler pins 4 exactly flushes with the periphery of the plug 2, said key being provided with a number of recesses in the upper edge corresponding to the number of locking pins, Thereby, the driver pins 5 are lifted free of the parting or shear surface between the plug 2 and the body 1, and the plug is free to be rotated in the body 1. If the key is removed, the locking pins assume the position shown in FIG. 2 on account of the bias from the springs 6, in which position the driver pins 5 intersect the parting surface between the body 1 and the plug 2. In this position the plug is prevented from being rotated.

In FIG. 3 the principle of opening a cylinder lock by means of a so-called gun tool is shown. The blade 8 of the lock pick tool is inserted and positioned in such a manner in the lock that it only just touches the lower end of all tumbler pins. When actuating the lock pick tool, its blade 8 performs a stroke-like movement in the direction of the arrow 9. By this stroke-like impact the force of impact is transmitted to the driver pins 5, whereas the tumbler pins only move to a slight extent. In the short period of time till the springs press the driver pins back against the tumbler pins, the lock is open and the plug may be rotated.

The invention aims at preventing such an opening of the cylinder lock. FIG. 4 shows a cylinder lock according to the invention during an attempt to open it by means of a gun lock pick tool i.e. in a situation corresponding to FIG. 3. According to the invention at least one of the driver pins 5 consists of two members 10 and 11. The two members are movable relative to each other in the longitudinal direction of the pin, and in the rest position the two members are forced into abutment against each other by means of the spring load. By actuating the lock pick tool the driver pins are pushed up with the exception of the two-piece driver pin, where only the member 10, which is not in contact with the tumbler pin 3, is thrust up. The member 11 in contact with the tumbler pin does not move, the impact energy being transmitted first through the tumbler pin and then through the member 11 to the movable member 10. The member 11 therefore remains stationary and extends through the parting surface between the plug 2 and the body 1. The plug is thereby prevented from being rotated. The invention makes use of the effect, which in traditional cylinder locks makes it possible with a special tool to open locks without using a key, to prevent such an opening from taking place. The impact energy is transmitted to a movable member in the driver pin without the part of the driver pin causing the locking effect being moved. The pick-proofing aimed at in the lock has thus been attained. It is advantageous, but no condition that the members of the driver pins have identical mass. To increase the security against the member 11 moving in spite of the impact energy being transmitted to the movable member 10, the member 11 may have a closer tolerance (tighter fit) in the associated bore than that of the remaining driver pins. In this way a friction between this driver pin and the bore is ensured.

FIGS. 5A, 5B and 5C show on an enlarged scale various embodiments of the driver pins which may be used in the cylinder lock according to the invention. The driver pin according to FIG. 5A is the one shown in FIG. 4. The driver pin consists of a bowl-like bottom member 12 and an upper member 13 comprising a shaft and a head. It is of importance for the effect of the invention that the two members have a well-defined contact surface (in this case between the shaft end and the bottom of the bowl), so that the power of impact via this contact portion may be transferred from the tumbler pin to the element 13 which is movable relative to the bowl-shaped member 12. The movable member must besides have a suitable surface, against which the spring may abut.

FIG. 5B shows an alternative embodiment, in which the movable member 14 is a ball resting in a corresponding recess in the member 15 abutting against the tumbler pin. FIG. 5C shows another alternative, in which the movable member 216 is substantially cylindrical and positioned in a cylindrical bowl 17 abutting the somewhat thickened bowl bottom. The cylindrical member 16 is provided with a conical top 18, which as shown in FIG. 5D forms a reliable seat for the spring.

FIGS. 6, 7 and 8 show other alternative embodiments of the driver pin which is used in the cylinder lock according to the invention. The driver pins according to FIGS. 6 and 7 are embodiments, in which the member in contact with the tumbler pin comprises a cavity, in which the movable member is enclosed. The advantage of such an embodiment is that the movability of the enclosed member is not influenced by dirt or congealed oil, which might otherwise impede the free movability. In such an embodiment it is important that the lock body is correctly orientated, as the gravity alone brings the movable member in place relative to the other member which is in contact with the tumbler pin. In an alternative embodiment shown in FIG. 8 the movable member is a ring which is displaceable on a slim shaft on the second member which is in contact with both the tumbler pin and the spring.

What is claimed is:

1. A cylinder lock with a body, in which a plug with a profiled, axially extending key slot is rotatably arranged, and in which the body and the plug are provided with a number of bores approximately perpendicular to the axis of the plug, in which bores a number of locking pins is provided, said locking pins comprising tumbler pins and driver pins, and in which the locking pins are lifted by insertion of a key such that the end faces of the tumbler pins flush with the circumferential surface of the plug, in which at least one of the driver pins comprises two members, of which a first member is movable relative to the second one in the longitudinal direction of the pins, wherein the movable member in the rest position abuts on the second member with a contact portion directed towards the plug, and wherein at least one driver pin consisting of two members has a closer tolerance in the associated bore compared to the remaining driver pins.

2. A cylinder lock according to claim 1, wherein the second member of the driver pin is a bowl having approximately the same diameter as that of the tumbler pins and having an open blind hole facing away from the plug, in which blind hole the first member is arranged.

3. A cylinder lock according to claim 2, wherein the spring for a driver pin consisting of two members abuts on the movable member.

4. A cylinder lock according to claim 2, wherein the two members of the driver pins have approximately identical masses.

5. A cylinder lock according to claim 1, wherein the driver pins comprise a tube closed at both ends, in which tube an axially movable mass is enclosed.

6. A cylinder lock according to claim 1, wherein the driver pins comprise a body of revolution with a slim shaft, about which a ring is axially movable.

7. A cylinder lock according to claim 1, wherein at least the central one of the driver pin or a driver pin placed close to the centre is provided with two members.

8. A cylinder lock with a body, in which a plug with a profiled, axially extending key slot is rotatably arranged, and in which the body and the plug are provided with a number of bores approximately perpendicular to the axis of the plug, in which bores a number of locking pins is provided, said locking pins comprising tumbler pins and driver pins, and in which the locking pins are lifted by insertion of a key such that the end faces of the tumbler pins flush with the circumferential surface of the plug, in which at least one of the driver pins comprises two members, of which a first member is movable relative to the second one in the longitudinal direction of the pins, wherein the movable member in the rest position abuts on the second member with a contact portion directed towards the plug, and wherein the second member of the driver pin is a bowl having approximately the same diameter as that of the tumbler pins and having an open blind hole facing away from the plug, in which blind hole the first member is arranged.

9. A cylinder lock with a body, in which a plug with a profiled, axially extending key slot is rotatably arranged, and in which the body and the plug are provided with a number of bores approximately perpendicular to the axis of the plug, in which bores a number of locking pins is provided, said locking pins comprising tumbler pins and driver pins, and in which the locking pins are lifted by insertion of a key such that the end faces of the tumbler pins flush with the circumferential surface of the plug, in which at least one of the driver pins comprises two members, of which a first member is movable relative to the second one in the longitudinal direction of the pins, wherein the movable member in the rest position abuts on the second member with a contact portion directed towards the plug, and wherein the driver pins comprise a tube closed at both ends, in which tube an axially movable mass is enclosed.

* * * * *